US009297606B2

(12) United States Patent
Harvey et al.

(10) Patent No.: US 9,297,606 B2
(45) Date of Patent: Mar. 29, 2016

(54) AIRSOFT GUN WITH GUN MOUNTED AIR SUPPLY SYSTEM

(71) Applicants: Daniel D. Harvey, Lake Geneva, WI (US); James Tentes, Salem, WI (US)

(72) Inventors: Daniel D. Harvey, Lake Geneva, WI (US); James Tentes, Salem, WI (US)

( * ) Notice: Subject to any disclaimer, the term of this patent is extended or adjusted under 35 U.S.C. 154(b) by 0 days.

(21) Appl. No.: 14/471,499

(22) Filed: Aug. 28, 2014

(65) Prior Publication Data

US 2015/0059726 A1 Mar. 5, 2015

Related U.S. Application Data

(60) Provisional application No. 61/871,977, filed on Aug. 30, 2013.

(51) Int. Cl.
*F41B 11/62* (2013.01)
*F41C 23/22* (2006.01)
*F41B 11/724* (2013.01)

(52) U.S. Cl.
CPC ..... *F41B 11/62* (2013.01); *F41C 23/22* (2013.01); *F41B 11/724* (2013.01)

(58) Field of Classification Search
CPC ..... F41B 11/62; F41B 11/60
USPC ..... 124/71–74, 75
See application file for complete search history.

(56) References Cited

U.S. PATENT DOCUMENTS

| | | | | |
|---|---|---|---|---|
| 8,087,406 | B2 * | 1/2012 | Axelsson | 124/71 |
| 8,671,928 | B2 * | 3/2014 | Hague et al. | 124/77 |
| 2002/0046747 | A1 * | 4/2002 | Colby | 124/73 |
| 2012/0192847 | A1 | 8/2012 | Hague et al. | |

* cited by examiner

*Primary Examiner* — Reginald Tillman, Jr.
(74) *Attorney, Agent, or Firm* — Andrus Intellectual Property Law, LLP

(57) ABSTRACT

An air supply system for use with an airsoft gun to power a pneumatic engine contained within a receiver of the airsoft gun. The air supply system includes a bottle of pressurized air that supplies the pressurized air at a first pressure to the pneumatic drive engine. A pressure regulator is located between the supply of pressurized air and the pneumatic drive engine and operates to reduce the pressure of the air from the first pressure to a second pressure. The pressure regulator is supported on the airsoft gun and allows the pressure of air supplied to the pneumatic engine of the airsoft gun to be selectively regulated. The pressure regulator includes an adjustment dial that allows an operator to change the pressure of air supplied to the airsoft gun. The pressure regulator can be located either on a stock of the airsoft gun, within a pistol grip of the airsoft gun or between the bottle of pressurized air and the receiver.

11 Claims, 14 Drawing Sheets

AIRSOFT GUN WITH GUN MOUNTED AIR SUPPLY SYSTEM

CROSS-REFERENCE TO RELATED APPLICATION

The present application is based on and claims priority to U.S. Provisional Patent Application Ser. No. 61/871,977 filed Aug. 30, 2013, the disclosure of which is incorporated herein by reference.

BACKGROUND

The present disclosure relates to a system and method for mounting an air supply system to an airsoft gun. More specifically, the present disclosure relates to a system for mounting both an air supply and regulator to the body of an airsoft gun Airsoft refers to a recreational activity in which replica firearms are used to shoot plastic BBs in the place of bullets or live ammunition. Airsoft guns are designed to have the appearance, weight and feel of the actual firearm upon which they are modeled. Airsoft guns shoot plastic BBs having a weight of approximately 0.2 grams.

Airsoft guns are used in recreational games that include a simulated battlefield where participants divide into multiple teams and attempt to achieve goals, such as capturing a flag or eliminating all of the opponents on the opposite team.

Most currently available airsoft guns utilize a combination pneumatic and spring power source to propel plastic BBs from the gun. These types of systems utilize a compressed spring to drive a piston within a cylinder, thereby compressing an in front of the piston to project the BB from a barrel. The spring can be compressed by human power or by an electric motor.

Polarstar Airsoft, of Newark, Del., has developed an HPA powered, solenoid driven, electronically controlled drop-in replacement engine for an airsoft weapon gearbox, referred to commercially as the Fusion Engine. The Fusion Engine is shown and described in U.S. Patent Publication No. 2012/0192847. The drop-in engine described in the referenced patent publication is driven by a tank of compressed air that is typically worn on the back of the player. The tank connects to the drop-in engine through a hose connected to the engine near the bottom of the pistol grip. The source of pressurized air and a regulator are typically worn on the back of the player and carried in some type of backpack arrangement. Although this type of compressed air supply functions adequately, it requires the player to have a hose running from the backpack to the pistol grip of the airsoft rifle.

SUMMARY

The present disclosure relates to an air supply system for use with an airsoft gun. More specifically, the present disclosure relates to an air supply system that includes a regulator supported by the body of the airsoft gun that modifies the pressure of air used to drive the pneumatic engine within the airsoft gun.

The pressure regulator of the air supply system is supported by the receiver of the airsoft gun such that the pressure regulator moves along with the rest of the airsoft gun. The pressure regulator includes an adjustment dial that can be used to control the pressure of air supplied to the airsoft gun from the pressure regulator. A protective cover can be positioned over the adjustment dial. The protective cover can receive a security device which will limit access to the adjustment dial until the protective cover is removed. The protective cover can be secured to the airsoft gun using a tamper-evident security device to prevent adjustment of the pressure of air leaving the pressure regulator.

In one embodiment of the disclosure, the bottle of pressurized air is supported on the receiver and located above a stock that is also mounted to the receiver. The stock can include a support bracket spaced from the receiver by a pair of support rods. The pressure regulator is mounted to the support bracket and is thus spaced from the receiver.

In another contemplated embodiment, the pressure regulator can be mounted between the bottle of pressurized air and the receiver. In such an embodiment, the pressure regulator supports the bottle of pressurized air above a stock also mounted to the receiver.

In yet another contemplated embodiment, the pressure regulator can be located within a pistol grip of the receiver. The adjustment dial of the pressure regulator is accessible through a bottom end of the pistol grip to allow adjustment of the output pressure from the pressure regulator. In such an embodiment, the bottle of pressurized air is supported by the receiver above a stock.

BRIEF DESCRIPTION OF THE DRAWINGS

The drawings illustrate the best mode presently contemplated of carrying out the disclosure. In the drawings.

DETAILED DESCRIPTION

Figure 1:
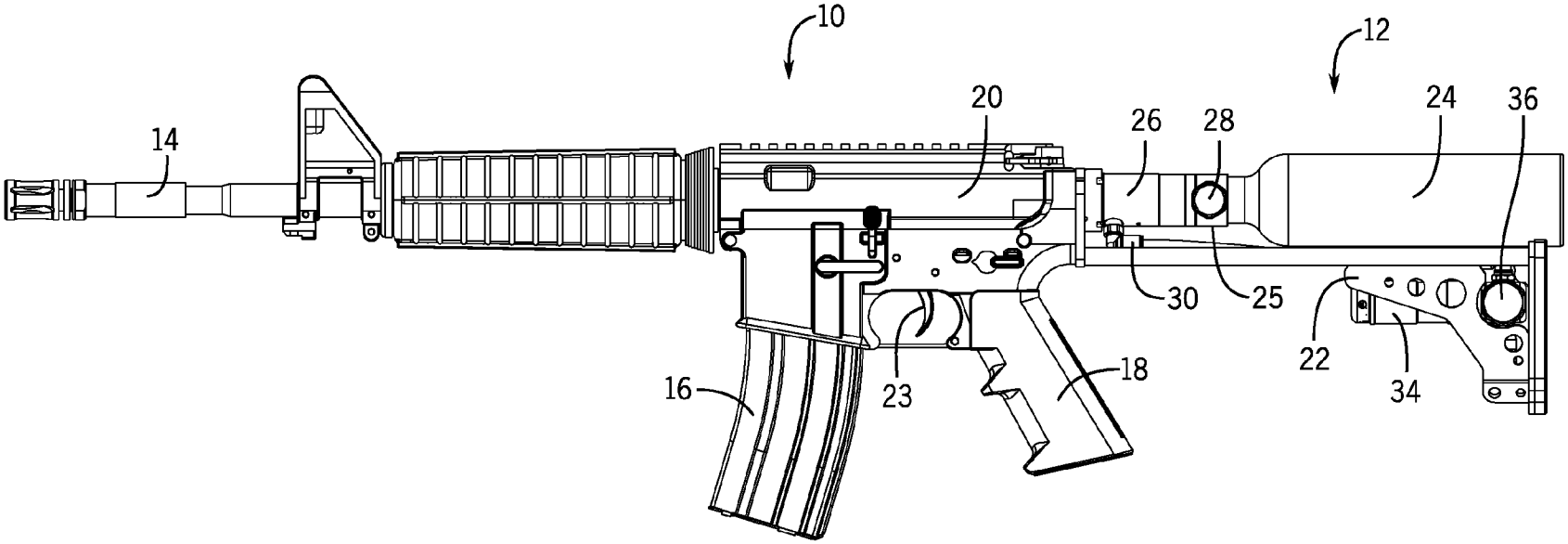
FIG. 1 is a side view of a first embodiment of an airsoft gun incorporating the mounted air supply in accordance with a first embodiment of the present disclosure.

FIGS. 1-4 illustrate a first embodiment of an airsoft gun 10 utilizing the gun mounted air supply system 12 of the present disclosure. The airsoft gun 10 shown in FIG. 1 has been designed to replicate the overall appearance of an AR-15. The airsoft gun 10 includes a barrel 14, a magazine 16, a pistol grip 18, a receiver 20 and a stock 22. The AR-15 shown in the drawing figures includes an upper receiver and a lower receiver, the combination of which are referred to as the receiver 20. Other models of firearms could include only a one-piece receiver. In the embodiment shown in FIG. 1, the compressed air source for the air supply system 12 is supported by the airsoft gun 10 and mounted to the stock 22 such that the airsoft gun 10 and the air supply system 12 can be utilized without any additional tubing or hoses running to the air supply system.

As indicated above, the airsoft gun 10 shown in FIGS. 1-4 incorporates the Fusion Engine available from Polarstar, which is described in U.S. Patent Publication No. 2012/0192847, the disclosure of which is incorporated herein by reference. As indicated above, the drop-in engine is contained within the receiver 20 and is powered by the air supply system 12 and propels BBs contained within the magazine 16 through the barrel 14 upon depression of the trigger 23. The drop-in engine is pneumatically powered and solenoid driven by an electronic control assembly. Although the Fusion Engine is shown in the preferred embodiment, the air supply system of the present disclosure could be used with other air powered airsoft guns, such as but not limited to Daytona Guns, classic gas blow back guns and hybrid gas blow back guns.

Figure 4:
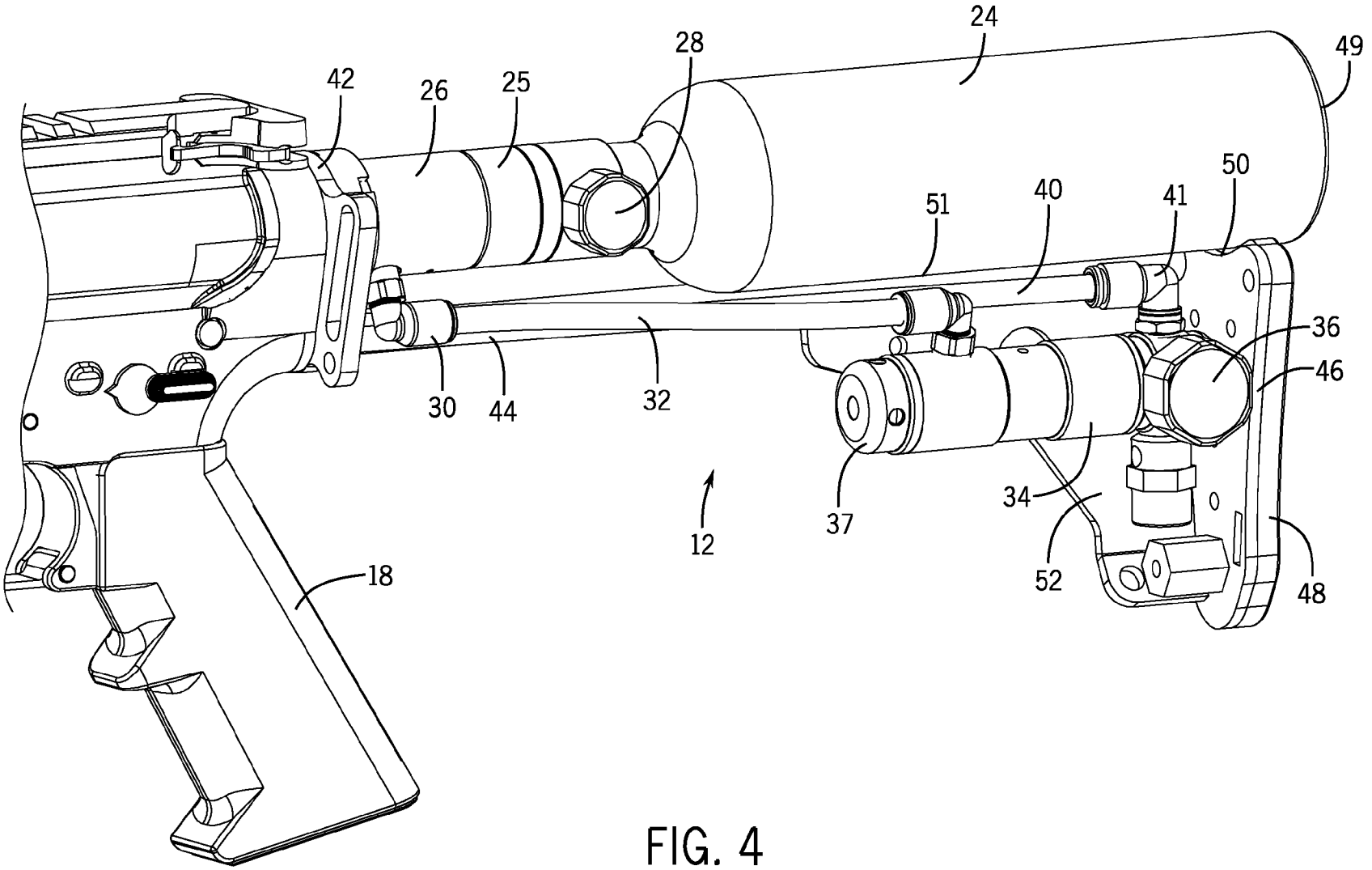
FIG. 4 is a magnified view similar to FIG. 3 further illustrating the position of the regulator.
Figure 4A:
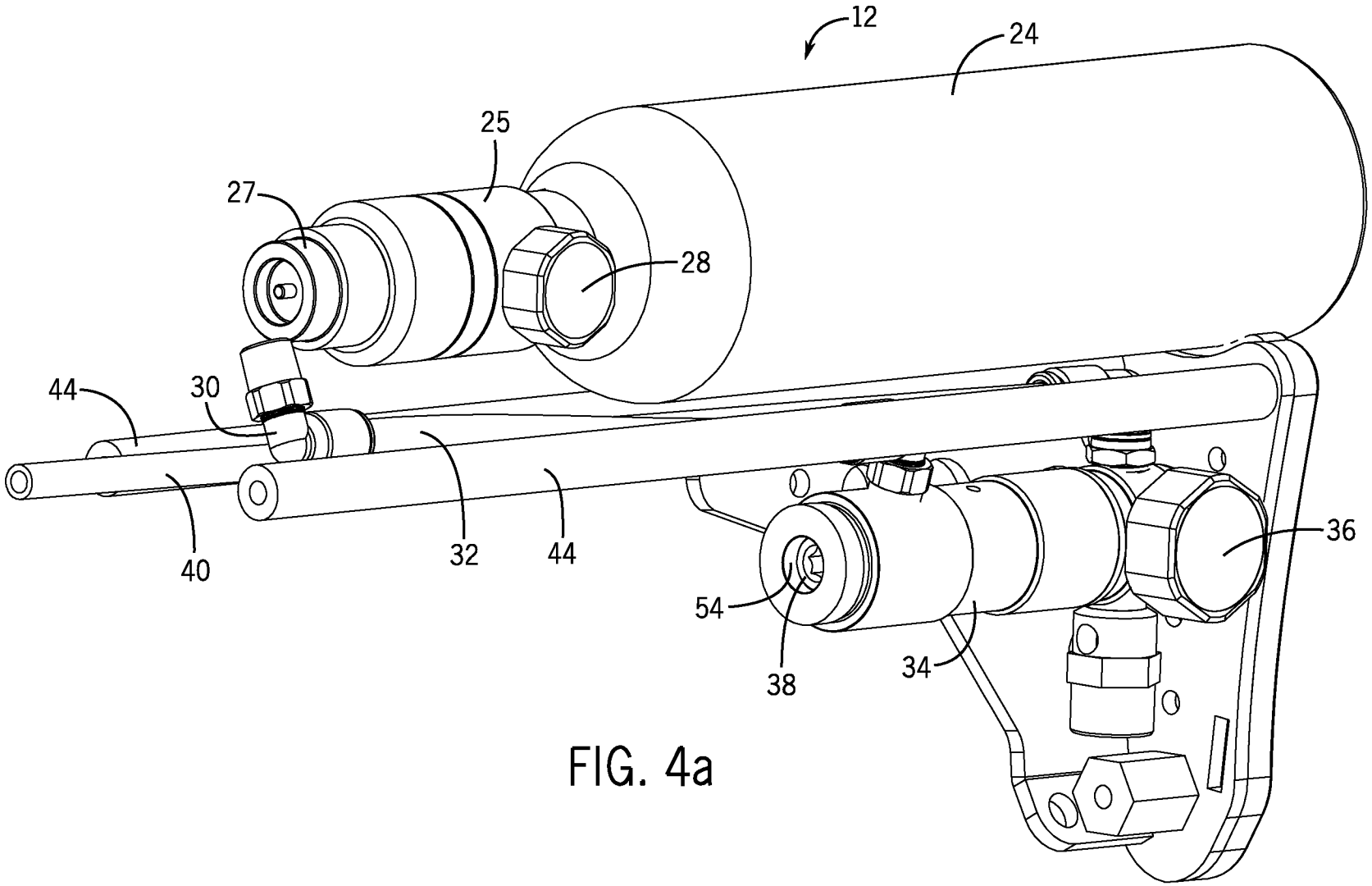
FIG. 4*a* is a view similar to FIG. 4 with various components hidden to show internal components of the mounted regulator.
Figure 5:
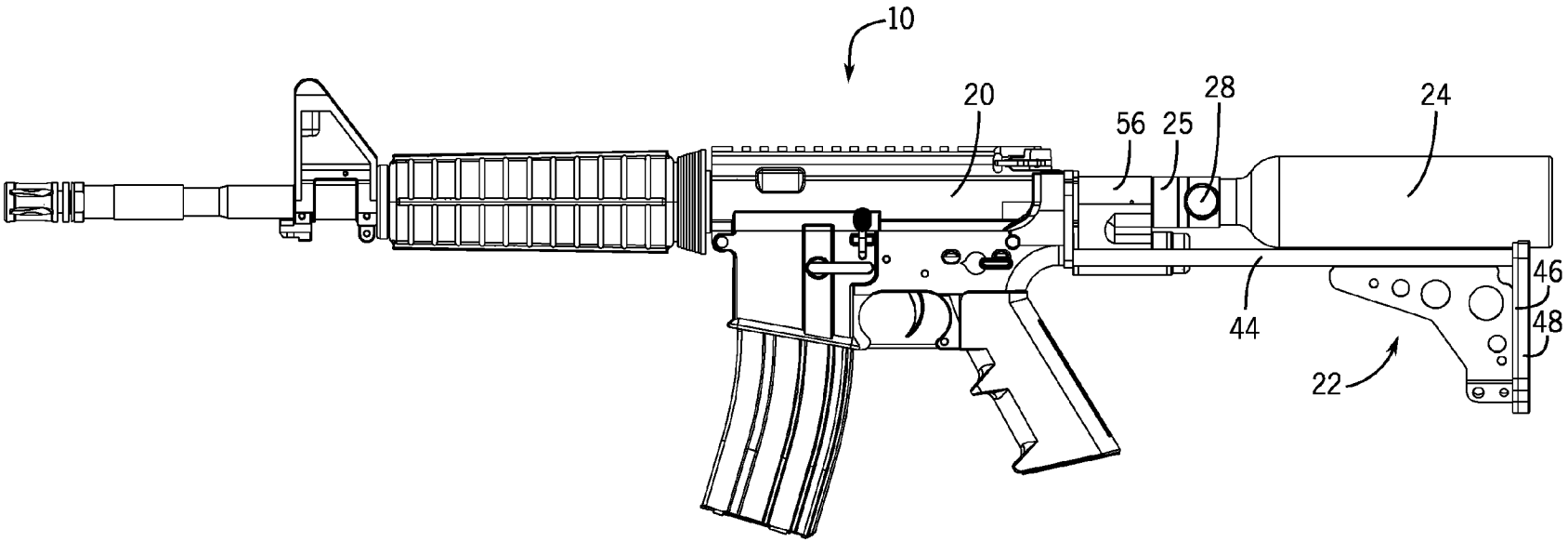
FIG. 5 is a side view of a second embodiment of an airsoft gun incorporating the mounted compressed air supply of the present disclosure.
Figure 6:
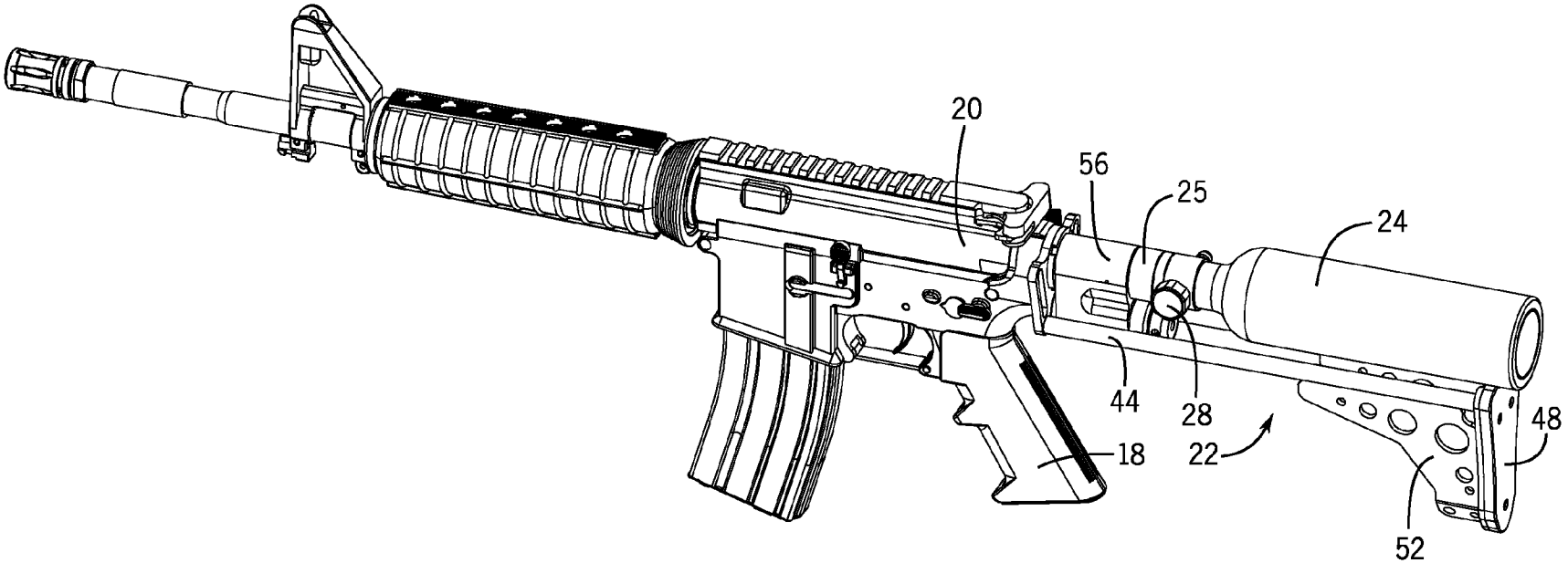
FIG. 6 is a perspective it of the second embodiment shown in FIG. 5.
Figure 7:
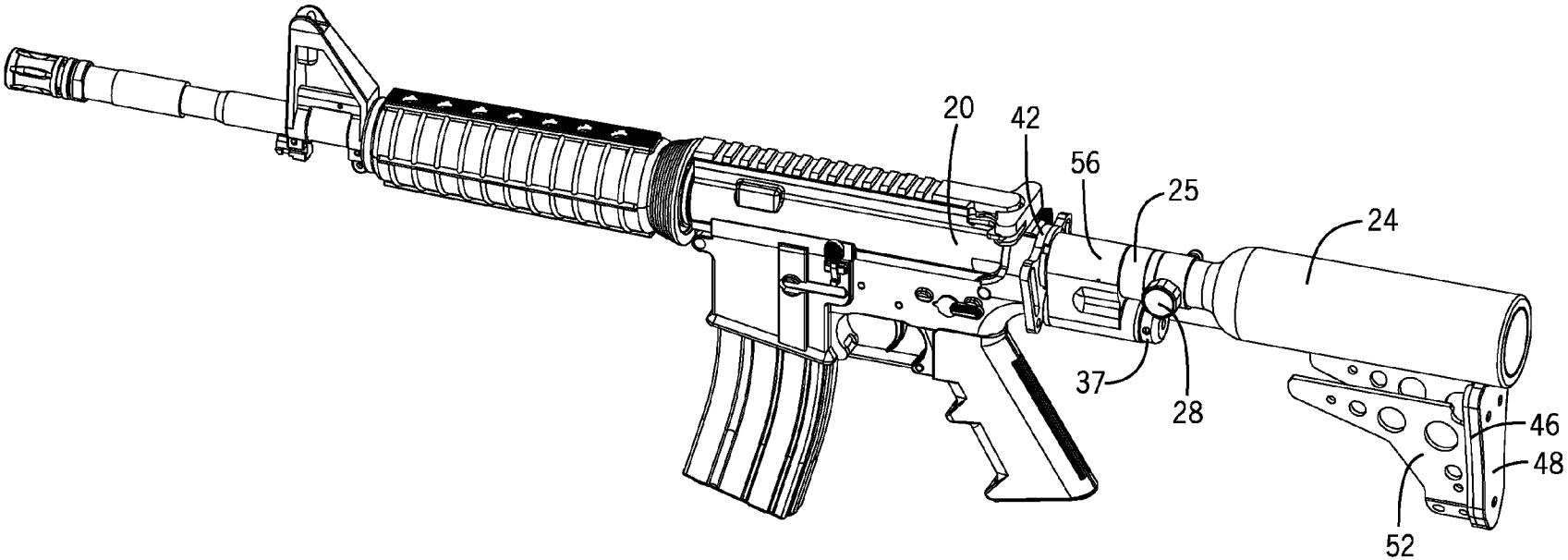
FIG. 7 is a view similar to FIG. 6 with several of the components removed to illustrate the position of the regulator.

As best shown in FIG. 4*a*, the air supply system 12 includes a high pressure tank or container, such as a bottle 24 of compressed gas having a tank regulator 25, a fill nipple 27 and a pressure gauge 28. The tank regulator 25 regulates the pressure of gas from the high pressure bottle 24 to a fixed output pressure typically between 300 and 900 psi, which is chosen at the time of purchase. Although a bottle 24 is shown, other types of tanks or containers could be used within the scope of the present disclosure.

As shown in FIGS. 1-4, a connecting sleeve 26 is located between the tank regulator 25 and the airsoft gun 10. The connecting, sleeve 26 includes an outlet fitting 30 having a supply hose 32, as best shown in FIG. 4. The supply hose 32 feeds pressurized air to a regulator 34. The regulator 34 includes a second pressure gauge 36. The regulator 34 further includes a protective cover 37 positioned over an adjustment dial for the regulator. The protective cover 37 is removed in FIG. 4*a* such that the adjustment dial 38 is shown. The adjustment dial 38 can be manipulated by the user to adjust the pressure of air leaving the regulator 34. As shown in FIG. 4, the air leaving the regulator 34 is supplied to the airsoft gun through the return hose 40 connected to an outlet air fitting 41 of the regulator 34. The return hose 40 enters into the receiver 20 and provides pneumatic power to the drop-in engine contained within the receiver 20.

Referring back to FIG. 4, a mounting, bracket 42 is positioned at the back end of the receiver 20 and provides a point of attachment for both the sleeve 26 and a pair of support rods 44. The support rods 44 extend to a support bracket 46 that includes a shoulder pad 48. The support bracket 46 can, in some instances, serve as a shoulder stock. Additionally, the butt end 49 of the bottle 24 could also be placed against the shoulder of the operator and used as a shoulder support.

Figure 2:
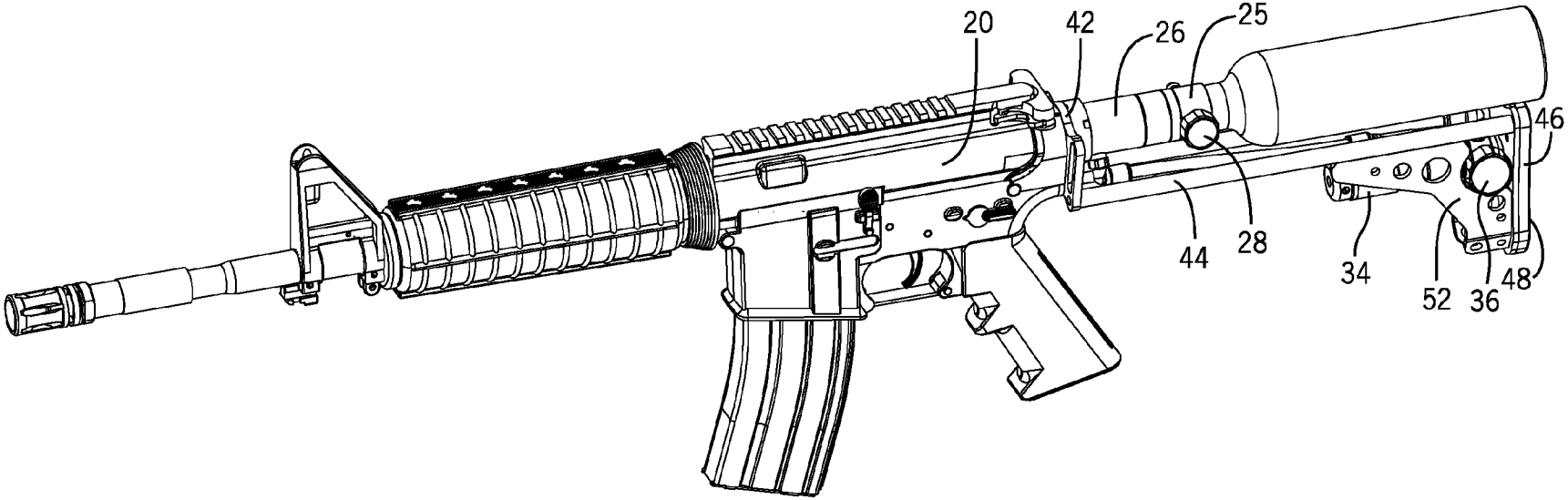
FIG. 2 is a perspective view illustrating the first embodiment shown in FIG. 1.
Figure 3:
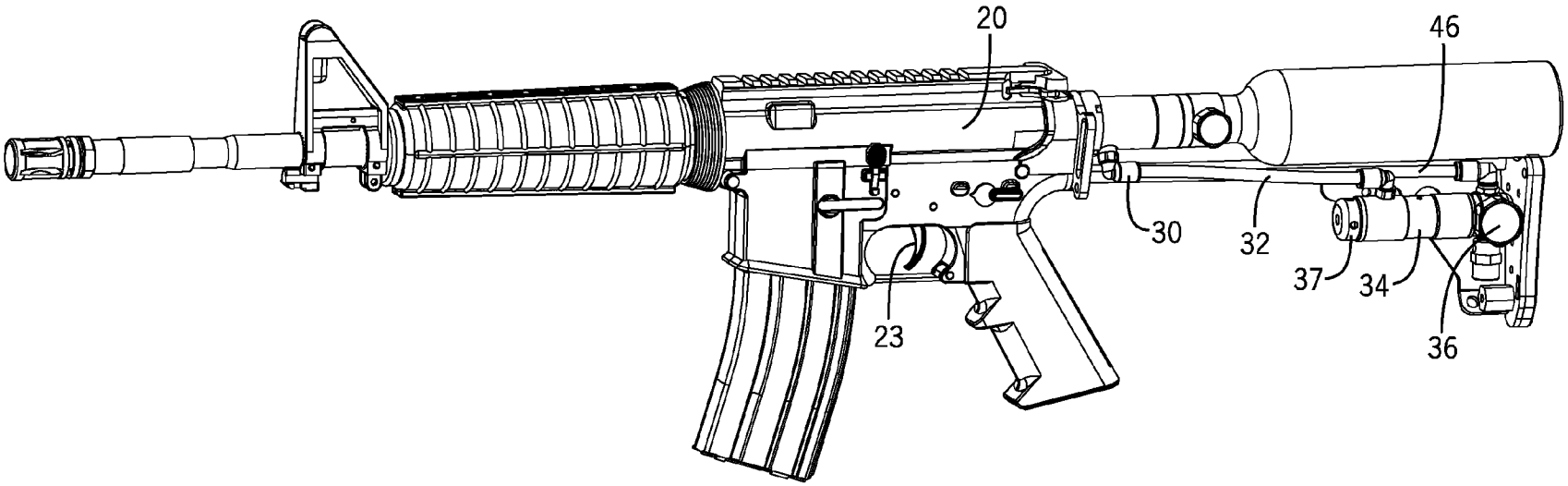
FIG. 3 is a view similar to FIG. 2 with one of the side brackets removed to illustrate the regulator.

As illustrated in FIG. 4, the support bracket 46 includes an upper surface 50 designed to be closely spaced from the curved, cylindrical outer surface 51 of the bottle 24. The bottle 24 is supported relative to the airsoft gun by the threaded connection between the bottle 24 and the receiver of the airsoft gun 10. The support bracket 46 provides a point of attachment for the regulator 34 such that the regulator 34 is also mounted to the airsoft gun. A pair of side brackets 52 partially encloses the regulator, as shown in FIG. 2. The side brackets 52 are preferably formed from a metallic material that is both durable and lightweight. It is contemplated that the bottle 24 could be carried by the operator and connected to the regulator 34 that is supported by the airsoft gun 10.

As shown in FIG. 4*a*, the regulator 34 includes the adjustment dial 38 having an access opening 54 that allows the user to adjust the pressure of air leaving the regulator through the return hose 40. The regulator 34 thus allows the user to reduce the pressure of gas present within the supply tube 32 that is connected to and fed by the high pressure bottle 24. In this manner, the regulator 34 can control the exit velocity of BBs from the airsoft gun 10. When the protective cover 37 is installed as shown in FIG. 4, the user can install a security device, such as a zip tie or similar device, to restrict the ability to insert a tool into the access opening 54. When the security device is installed and the protective cover 37 is in place, the user is unable to change the pressure of the air supplied to the drive engine of the airsoft gun. During competition, the protective cover 37 can be connected to the airsoft min by a security devices, such as a plastic tie or other device, to prevent the operator for changing the air pressure during the competition.

FIGS. 5-8 illustrate a second embodiment of the airsoft gun 10. In the embodiment shown in FIGS. 5-8, a regulator 56 is positioned directly between the tank regulator 25 connected to the bottle 24 and the rear end of the receiver 20. The stock 22 still includes the pair of support rods 44, the support bracket 46 and the shoulder pad 48. However, in the embodiment shown in FIG. 5, the regulator 56 is no longer attached to the support bracket 46 as in the first embodiment and instead is positioned directly between tank regulator 25 and the receiver 20.

Figure 8:
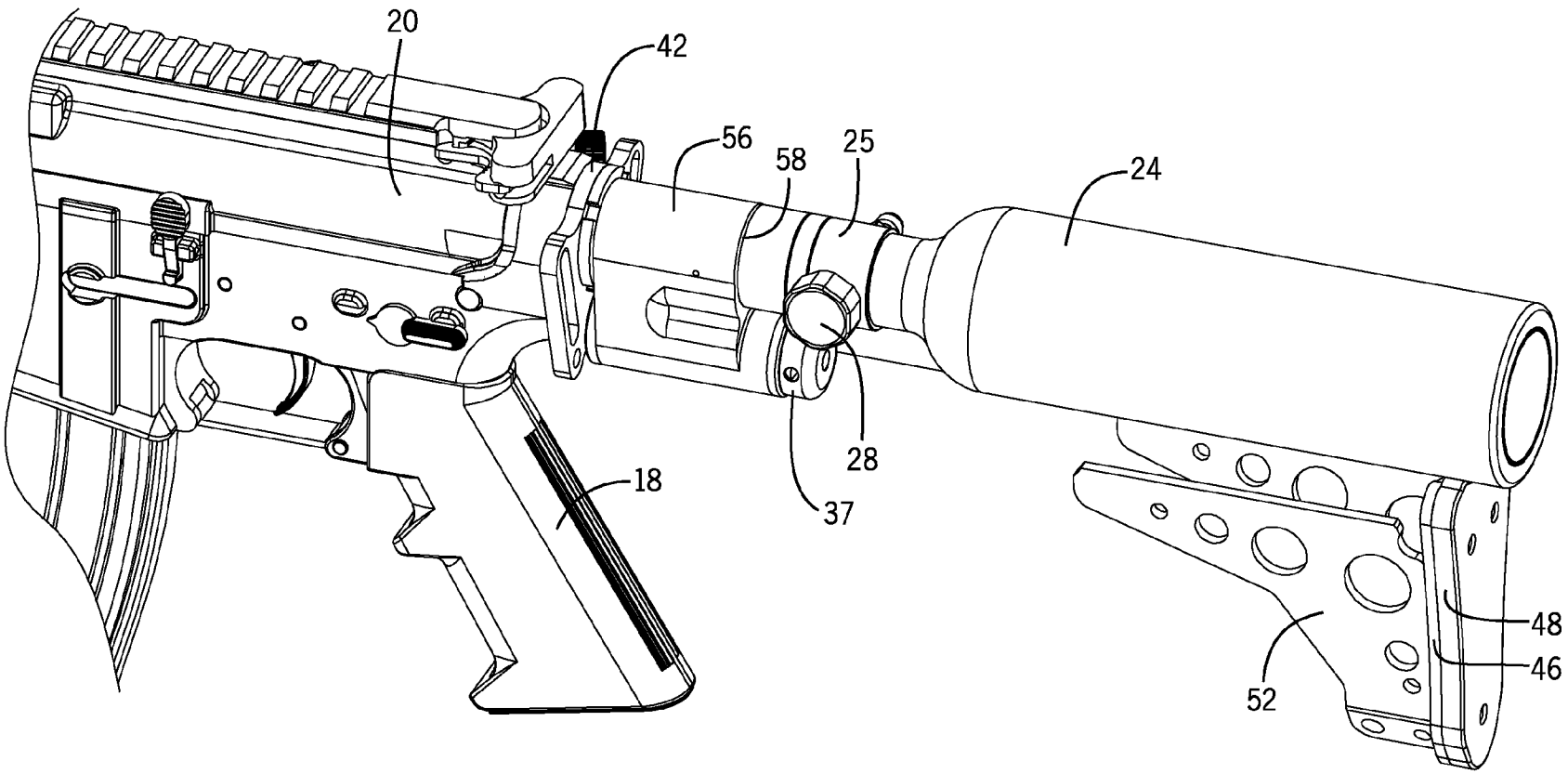
FIG. 8 is a magnified view similar to FIG. 7.
Figure 9:
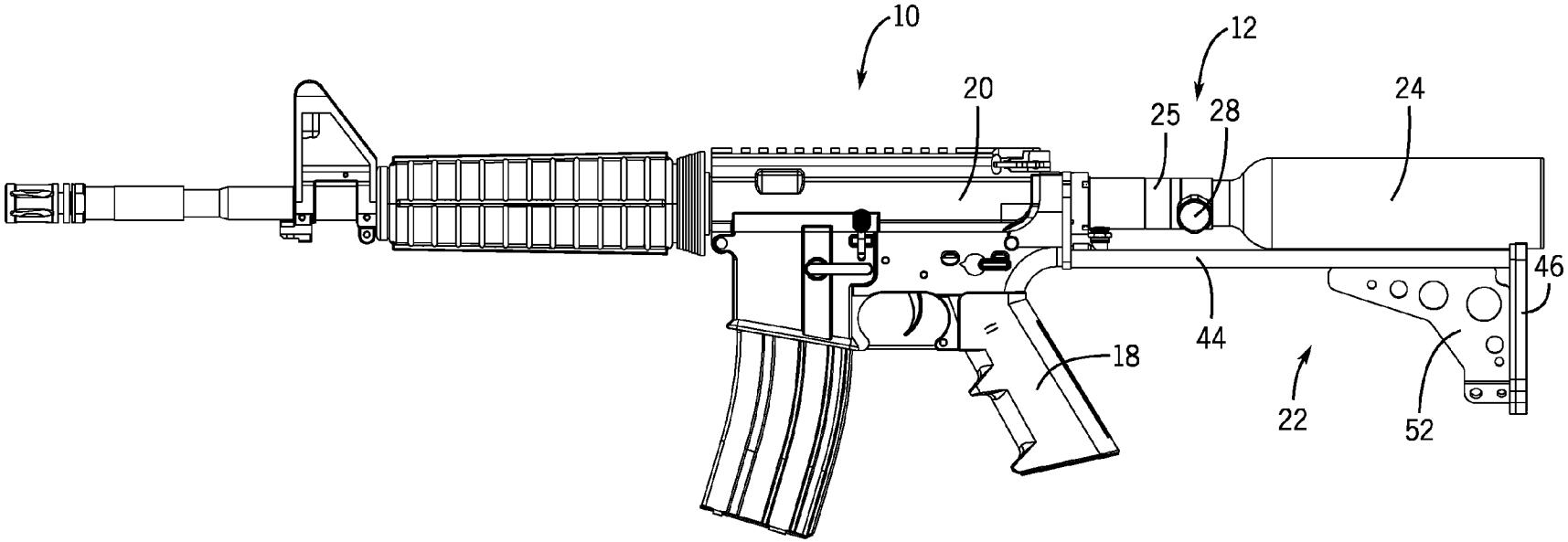
FIG. 9 is a side view of a third embodiment of the airsoft gun including the mounted air supply and regulator.

As best illustrated in FIG. 8, the regulator 56 includes an upper attachment portion 58 and the lower adjustment dial shown covered by the protective cover 37. The adjustment dial in the embodiment shown in FIG. 8 is similar to the adjustment dial shown in FIG. 4*a* in that the adjustment dial includes an opening 54 that allows the user to adjust the pressure of air entering into the receiver. The embodiment shown in FIGS. 6-8 eliminates the pair of hoses 32 and 40 shown in the first embodiment of FIGS. 1-4.

Although the second embodiment shown in FIGS. 5-8 moves the location of the regulator 56 to a location between the tank regulator 25 and the receiver 20, the airsoft gun 10 still includes the pair of support rods 44 extending from the mounting bracket 42 attached to the receiver to the support bracket 46. The support bracket 46 includes the shoulder pad 48 as well as the pair of side brackets 52. The support bracket 46 is once again designed to correspond to the curved outer surface of the bottle 24.

The regulator 56 shown in FIG. 8 includes internal gas passageways that allow the pressurized gas from the bottle 24 to pass through the regulator 56 and be reduced in pressure based upon the position of the adjustment dial. As in the first embodiment shown in FIGS. 1-4, the embodiment of FIGS. 5-8 allows the entire air supply system to be mounted directly to the receiver 20 and thus carried as part of the airsoft gun 10.

FIGS. 9-13 illustrate a third embodiment for the air supply system 12 of the present disclosure. Like the embodiments shown in the earlier figures, the embodiment shown in FIG. 9 incorporates the air supply system 12 directly on the airsoft gun 10. As in the previous embodiments, the air supply system 12 includes a bottle 24 of pressurized gas supported above the stock 22. The stock 22 includes the pair of support rods 44 each connected to the support bracket 46. The support rods 44 and the support bracket 46 also are connected to a pair of side brackets 52. The bottle 24 includes the tank regulator 25 and the sleeve 26 which includes the pressure gauge 28.

Figure 10:
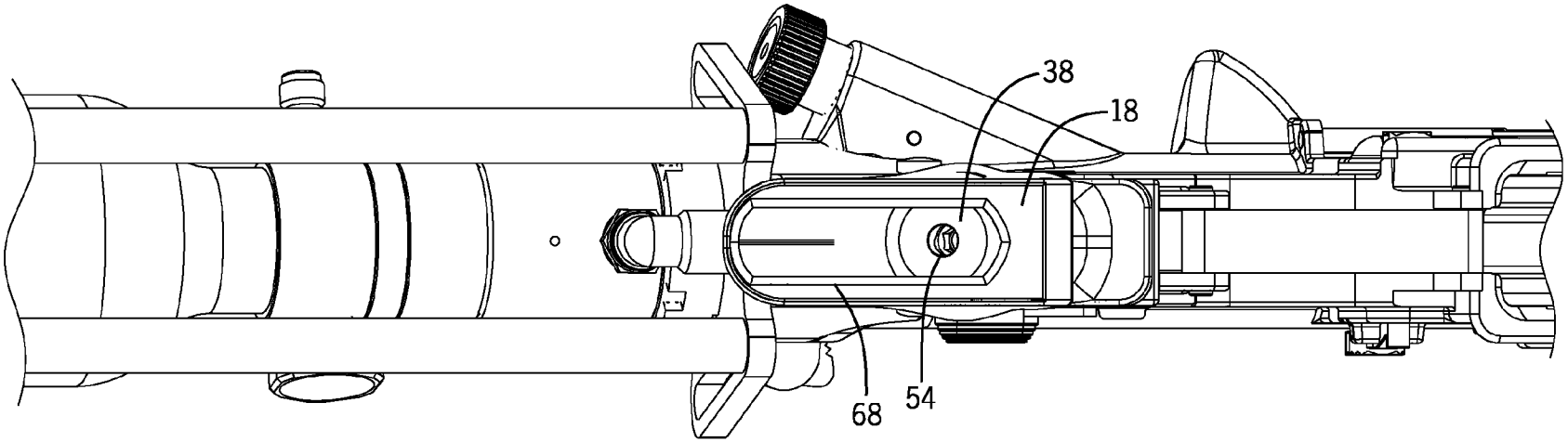
FIG. 10 is a bottom view illustrating the adjustment location for the regulator.
Figure 11:
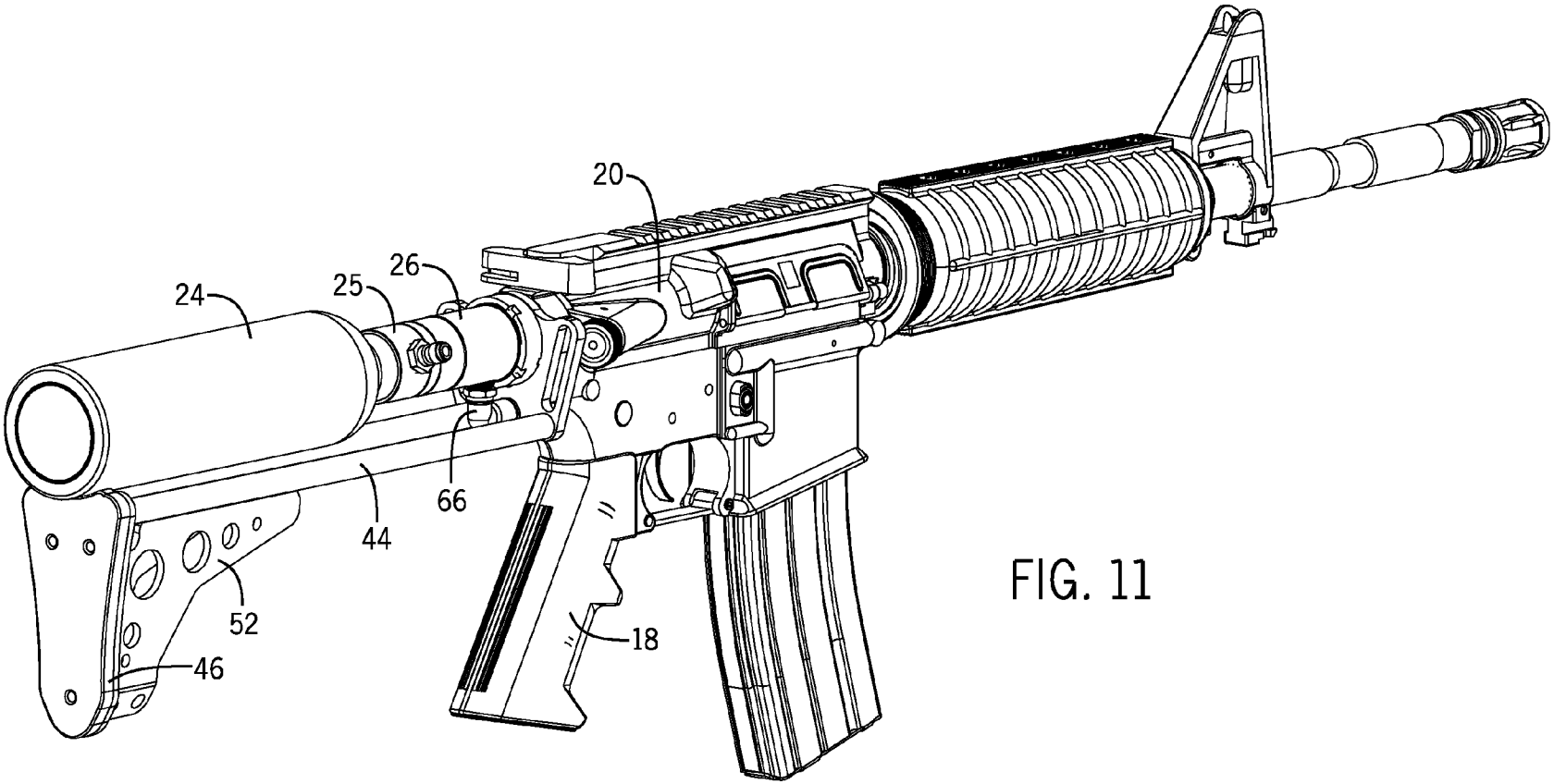
FIG. 11 is a perspective view of the third embodiment showing the connection of the air supply to the regulator.
Figure 12:
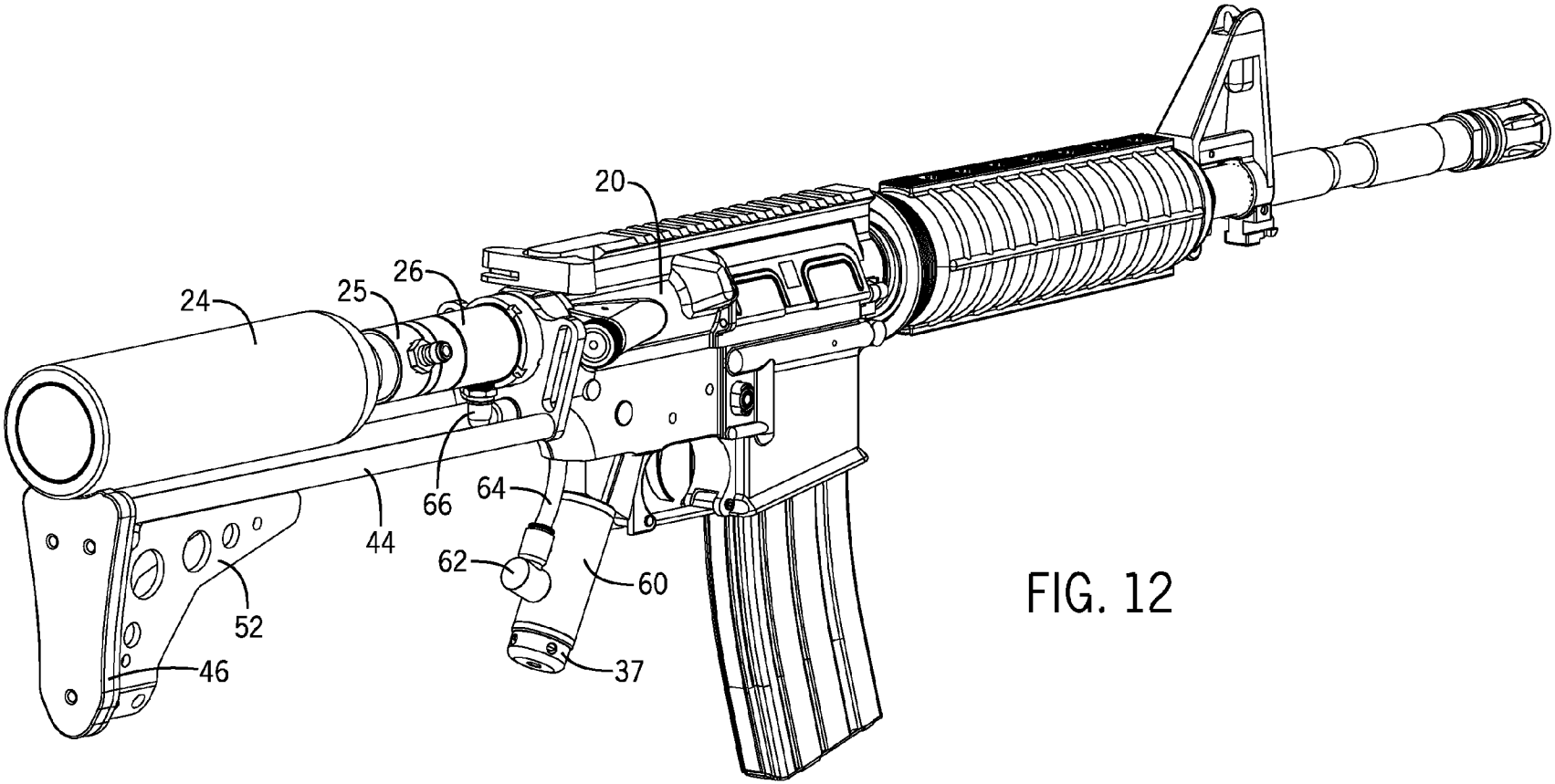
FIG. 12 is a view similar to FIG. 11 with the pistol grip hidden to illustrate the location of the regulator.
Figure 13:
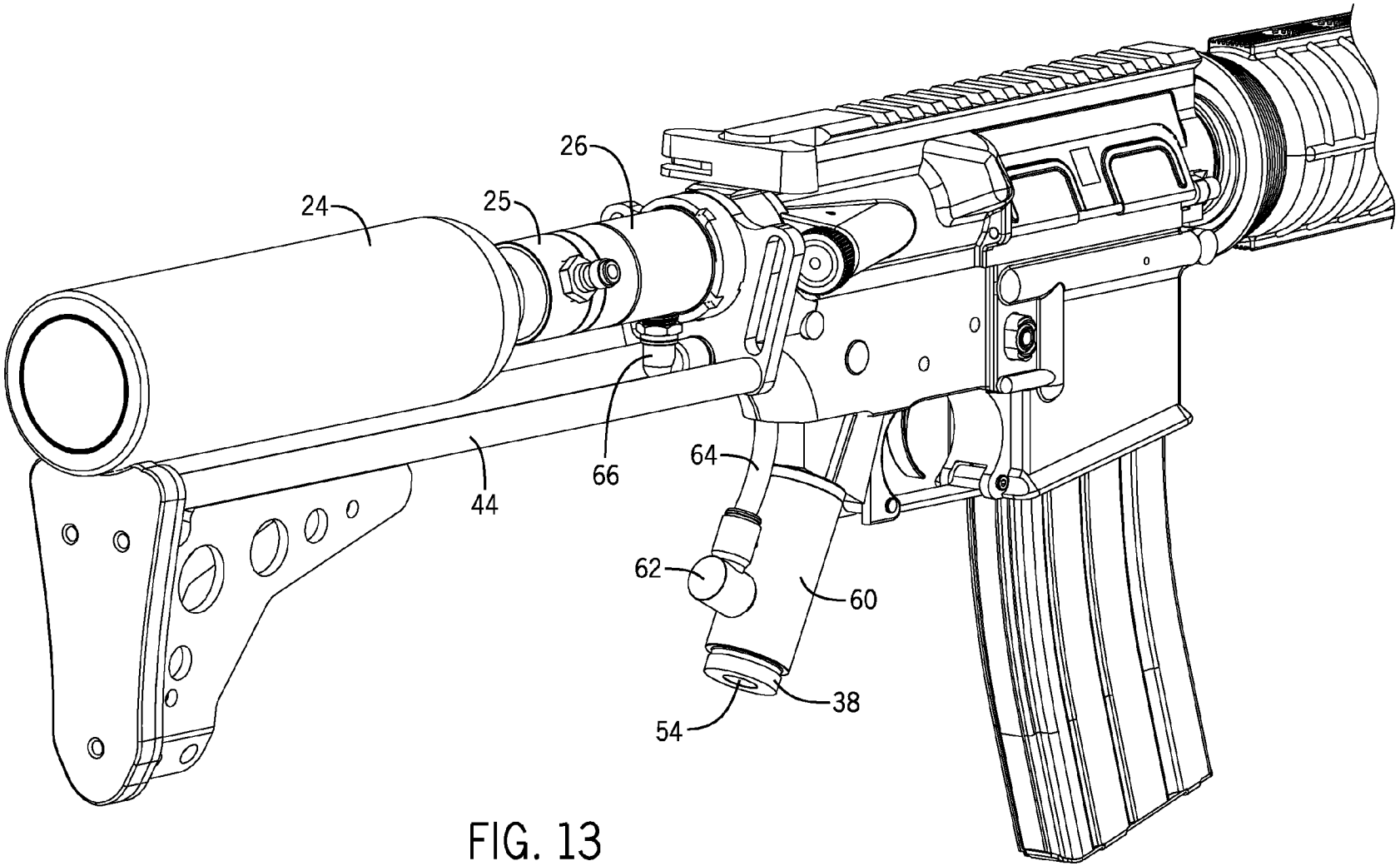
FIG. 13 is a view similar to FIG. 12 further showing the location of the regulator.

In the third embodiment, as best shown in FIG. 12, a regulator 60 is contained within the pistol grip 18, shown in FIG. 11. As can be understood in the comparison of FIGS. 11 and 12, the regulator 60 is concealed by the pistol grip 18. The regulator 60 includes a connector 62 that receives the air supply hose 64. The air supply hose 64 is connected to the sleeve 26 by the fitting 66 and receives the supply of pressurized air from the tank 24. The air supply hose 64 passes through a portion of the receiver 20 and into the regulator 60. The regulator 60 includes the cover 37 that conceals the adjustment dial 38, as can be seen in the comparison of FIGS. 12 and 13. As in the previous embodiments, an opening 54 in the adjustment dial 38 allows the operator to adjust the pressure of air leaving the regulator 60. As illustrated in FIG. 10, the opening 54 of the adjustment dial 38 is accessible through a lower opening 68 formed in the bottom of the pistol grip 18.

The output of the regulator 60 is connected to the internal engine contained within the receiver 20 to provide pressurized air to the engine to propel BBs from the airsoft gun.

As can be understood in the FIGS. 9-13, the regulator 60 is concealed within the pistol grip 18 and is accessible through an opening formed in the bottom end of the pistol grip 18.

In the three embodiments shown in the drawing Figures, the entire air supply system, including the supply of pressurized air and a regulator, is mounted directly to the airsoft gun 10. In this manner, the disclosure eliminates the need for a backpack mounted supply of pressurized air and external hoses extending from the supply of air to the airsoft gun. However, a backpack mounted supply of air could be used and connected to the regulator 60.

In yet another contemplated embodiment, the pressure regulator 60 shown in the pistol grip 18 of FIG. 12 could be incorporated directly into the pneumatic engine contained in the receiver 20. In such an embodiment, the pressure regulator 60 would be integrated into the engine during manufacture of the engine. The pressure regulator 60 would be contained within the receiver 20 and would include an adjustment dial to adjust the pressure of the air used to drive the pneumatic engine. The adjustment dial could be accessible from the bottom of the pistol grip 18, similar to the embodiment of FIG. 12. Incorporating the pressure regulator 60 directly into the engine would eliminate the hoses that extend from the engine to the regulator in the embodiments shown in the figures of the present disclosure.

Although an AR-15 is shown in all of the embodiments, it is understood that various different airsoft guns could be utilized while operating within the scope of the present disclosure. In accordance with the present disclosure, the entire air supply system is supported and mounted to the airsoft gun such that no external hoses running from the airsoft gun to the supply of pressurized air are needed.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. An air supply system for use with an airsoft gun that includes a receiver that includes a drive engine that launches solid plastic projectiles through a barrel, comprising:

a self-contained bottle of pressurized air having an outlet that provides air at a first pressure;

a stock mounted to a back end of the receiver that is distal to a barrel end, wherein the bottle of pressurized air is located above the stock and the stock at least partially supports the bottle of pressurized air at a position other than at the outlet;

a pressure regulator supported by the stock, wherein the pressure regulator receives the supply of air at the first pressure and discharges the supply of air at a second pressure lower than the first pressure; and an adjustment dial formed on the pressure regulator, wherein the adjustment dial is movable to adjust the second pressure.

2. The air supply system of claim 1 wherein the stock includes a pair of support rods connected to the back end of the receiver and a support bracket connected to the pair of support rods.

3. The air supply system of claim 2 wherein the pressure regulator is mounted to the support bracket and spaced from the receiver.

4. An airsoft gun, comprising:

a receiver having a trigger and operable to launch solid plastic projectiles;

a barrel connected to the receiver to receive the solid plastic projectiles;

a bottle of pressurized air having an outlet that supplies air at a first pressure;

a stock mounted to a back end of the receiver that is distal to a barrel end, wherein the bottle of pressurized air is located above the stock and the stock at least partially supports the bottle of pressurized air at a position other than at the outlet;

a pressure regulator supported by the back end of the receiver and positioned between the back end of the receiver and the bottle, wherein the pressure regulator receives the supply of air at the first pressure and discharges the supply of air at a second pressure lower than the first pressure; and an adjustment dial formed on the pressure regulator, wherein the adjustment dial is movable to adjust the second pressure.

5. The air supply system of claim 1 further comprising a protective cover positioned over the adjustment dial, wherein the protective cover receives a security device to restrict access to the adjustment dial.

6. The airsoft gun of claim 4 wherein an upper portion of the regulator receives the bottle of pressurized air and a lower portion of the regulator includes the adjustment dial.

7. The airsoft gun of claim 4 further comprising a protective cover positioned over the adjustment dial.

8. An airsoft gun, comprising:

a receiver having a trigger and a drive engine operable to launch solid plastic projectiles;

a barrel connected to the receiver to receive the solid plastic projectiles;

a bottle of pressurized air having an outlet that supplies air at a first pressure;

a pistol grip supported by the receiver;

a pressure regulator contained within the pistol grip, wherein the pressure regulator receives the supply of air at the first pressure and discharges the supply of air at a second pressure lower than the first pressure; and an adjustment dial associated with the pressure regulator and movable to adjust the second pressure.

9. The airsoft gun of claim 8, further comprising a stock mounted to a back end of the receiver that is distal to a barrel end, wherein the bottle of pressurized air is located above the stock and the stock at least partially supports the bottle of pressurized air at a position other than at the bottle's output.

10. The airsoft gun of claim 9, wherein the stock includes a pair of support rods connected to the receiver and a support bracket connected to the pair of support rods.

11. The airsoft gun of claim 8, further comprising a protective cover positioned over the adjustment dial.

* * * * *